US007161547B2

(12) United States Patent
Yanagi et al.

(10) Patent No.: US 7,161,547 B2
(45) Date of Patent: Jan. 9, 2007

(54) ANTENNA DEVICE

(75) Inventors: Masahiro Yanagi, Shinagawa (JP); Shigemi Kurashima, Shinagawa (JP); Hiroto Inoue, Shinagawa (JP); Takuya Uchiyama, Shinagawa (JP); Junichi Akama, Shinagawa (JP); Noboru Fujii, Shinagawa (JP); Takashi Arita, Shinagawa (JP)

(73) Assignee: Fujitsu Component Limited, Tokyo (JP)

( * ) Notice: Subject to any disclaimer, the term of this patent is extended or adjusted under 35 U.S.C. 154(b) by 0 days.

(21) Appl. No.: 10/954,204

(22) Filed: Oct. 1, 2004

(65) Prior Publication Data

US 2005/0264462 A1 Dec. 1, 2005

(30) Foreign Application Priority Data

Mar. 9, 2004 (JP) ..... 2004-066117

(51) Int. Cl.
*H01Q 9/00* (2006.01)
*H01Q 1/38* (2006.01)

(52) U.S. Cl. ..... 343/752; 343/700 MS

(58) Field of Classification Search ..... 343/700 MS, 343/752, 828, 829, 848
See application file for complete search history.

(56) References Cited

U.S. PATENT DOCUMENTS

| | | | | |
|---|---|---|---|---|
| 5,181,044 | A * | 1/1993 | Matsumoto et al. | 343/752 |
| 6,788,265 | B1 * | 9/2004 | Kuramoto | 343/752 |
| 6,917,341 | B1 * | 7/2005 | Ishihara et al. | 343/752 |
| 7,038,631 | B1 * | 5/2006 | Jecko et al. | 343/767 |

OTHER PUBLICATIONS

"An Omnidirectional and Low VSWR Antenna for the FCC-Approved UWB Frequency Band", Takuya Taniguchi and Takehiko Kobayashi, published by the Institute of Electronics, Information and Communication Engineers, B-1-133, p. 133 (Mar. 22, 2003).

* cited by examiner

*Primary Examiner*—Shih-Chao Chen
(74) *Attorney, Agent, or Firm*—Staas & Halsey LLP

(57) ABSTRACT

A disclosed antenna device includes a ground plate, a feeding unit that extends from the ground plate at a predetermined angle for a predetermined length, the feeding unit being prepared perpendicular to the ground plate, and a non-conductive section formed in the ground plate. The shape of the non-conductive section is adjusted according to a desired frequency characteristic.

7 Claims, 16 Drawing Sheets

ANTENNA DEVICE

BACKGROUND OF THE INVENTION

1. Field of the Invention

The present invention generally relates to an antenna device, and especially relates to an antenna device that includes a ground plate that is shaped like a plate, and a feeding unit that extends at a predetermined angle from the ground plate for a predetermined length, the feeding unit being prepared perpendicular to the ground plate.

2. Description of the Related Art

In recent years and continuing, radio communications technology using UWB (ultra-wide band) attracts attention since radar positioning and communications at a large transmission capacity are possible. As for UWB, U.S. FCC (Federal Communications Commission) allowed use of a 3.1–10.6 GHz band in 2002.

Communications at UWB are performed by sending a pulse signal using a wide frequency band. Accordingly, an antenna device used for UWB has to be capable of receiving a wide band signal.

For UWB communications, at least in the 3.1–10.6 GHz frequency band approved by the FCC, an antenna device consisting of a ground plate and a feeder is proposed (Non-patent Reference 1).

FIGS. 1A and 1B show structures of conventional antennas, and FIG. 2 is a schematic diagram of a conventional antenna device.

An antenna 10 shown in FIG. 1A is constituted by a feeding unit 12 in the shape of a circular cone arranged on a ground plate 11 with the top (apex) of the circular cone facing the ground plate 11.

Here, the circular cone is set up such that the side of the circular cone and the ground plate 11 make an angle θ. A desired antenna device property is obtained by setting the angle θ.

An antenna 20 shown in FIG. 1B is constituted by a feeding unit 22 in the shape of a teardrop that includes a circular cone 22*a*, and a sphere 22*b* inscribed in the circular cone 22*a*. Here, the feeding unit 22 is arranged on the ground plate 11 with the top of the circular cone 22*a* facing the ground plate 11.

The feeding units 12 and 22 of the antennas 10 and 20, respectively, are connected to a filter 31, as shown in FIG. 2. The filter 31 extracts frequency components in a desired frequency band from a radio wave received by the feeding unit 12. The frequency components extracted by the filter 31 are provided to a transceiver unit 32. The transceiver unit 32 performs signal processing to the radio wave received, and a radio wave to be transmitted.

[Non-Patenting Reference 1]

"An Omnidirectional and Low-VSWR Antenna for the FCC-Approved UWB Frequency Band", published by The Institute of Electronics, Information and Communication Engineers, B-1-133, page 133, Takuya Taniguchi and Takehiko Kobayashi (The Tokyo Electric University) (Presented on Mar. 22, 2003 at classroom B201).

DESCRIPTION OF THE INVENTION

[Problem(s) to be Solved by the Invention]

As described above, the conventional wideband antenna device needs to have a filter for sorting out a radio wave in addition to an antenna.

SUMMARY OF THE INVENTION

It is a general object of the present invention to provide an antenna device that substantially obviates one or more of the problems caused by the limitations and disadvantages of the related art.

Features and advantages of the present invention are set forth in the description that follows, and in part will become apparent from the description and the accompanying drawings, or may be learned by practice of the invention according to the teachings provided in the description. Objects as well as other features and advantages of the present invention will be realized and attained by an antenna device particularly pointed out in the specification in such full, clear, concise, and exact terms as to enable a person having ordinary skill in the art to practice the invention.

To achieve these and other advantages and in accordance with the purpose of the invention, as embodied and broadly described herein, the present invention provides an antenna device that includes a ground plate and a feeding unit. Therein, the feeding unit extends from the ground plate at a predetermined angle for a predetermined length, the feeding unit being prepared perpendicular to the ground plate. Further, the ground plate includes a non-conductive section that is formed in a shape corresponding to a desired frequency to pass.

In this manner, there is no need for an additional external filter, simplifying the structure of the antenna device.

DESCRIPTION OF THE PREFERRED EMBODIMENTS

In the following, embodiments of the present invention are described with reference to the accompanying drawings.

[The First Embodiment]

Figure 1A:
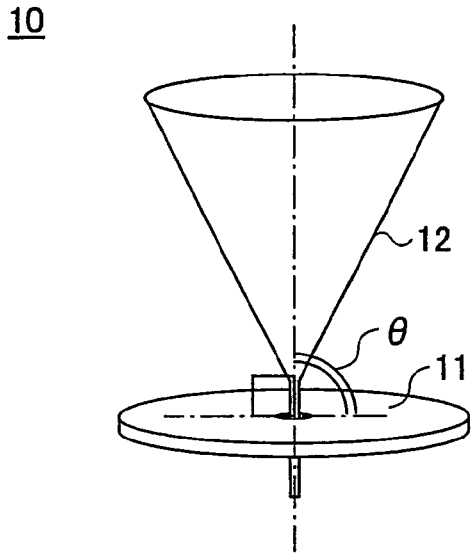
PRIOR ART FIG.1A
FIGS. 1A and 1B are schematic diagrams of an example of conventional antennas.
Figure 1B:
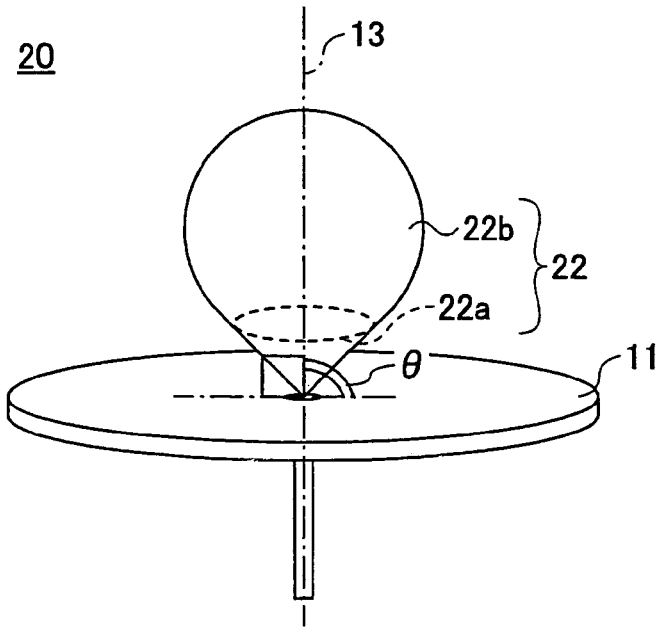
PRIOR ART FIG.1B
Figure 2:
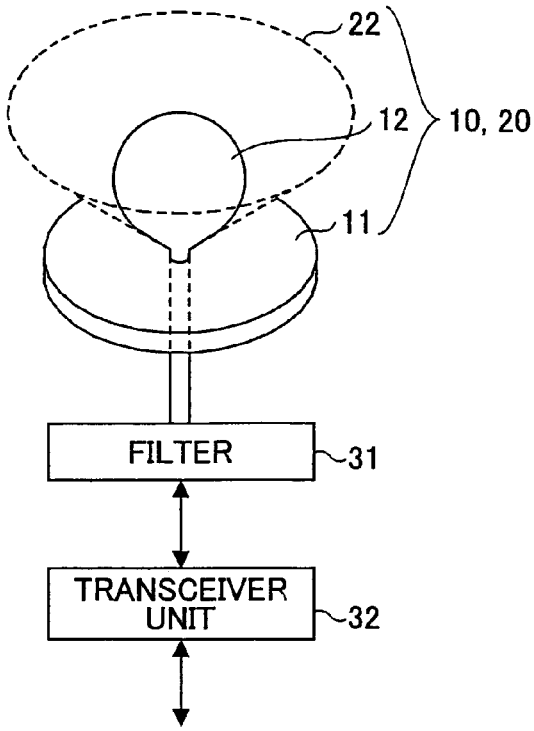
PRIOR ART FIG.2
FIG. 2 is a schematic diagram of the conventional antenna device.
Figure 3:
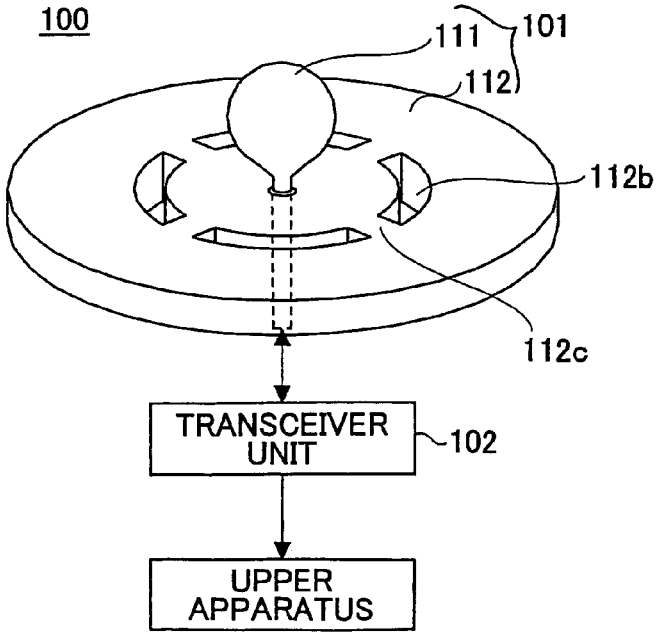
FIG. 3 is a schematic diagram of a first embodiment of the present invention.

FIG. 3 is a schematic diagram of an antenna device 100 according to the first embodiment of the present invention.

The antenna device 100 includes an antenna 101 and a transceiver unit 102.

Figure 4A:
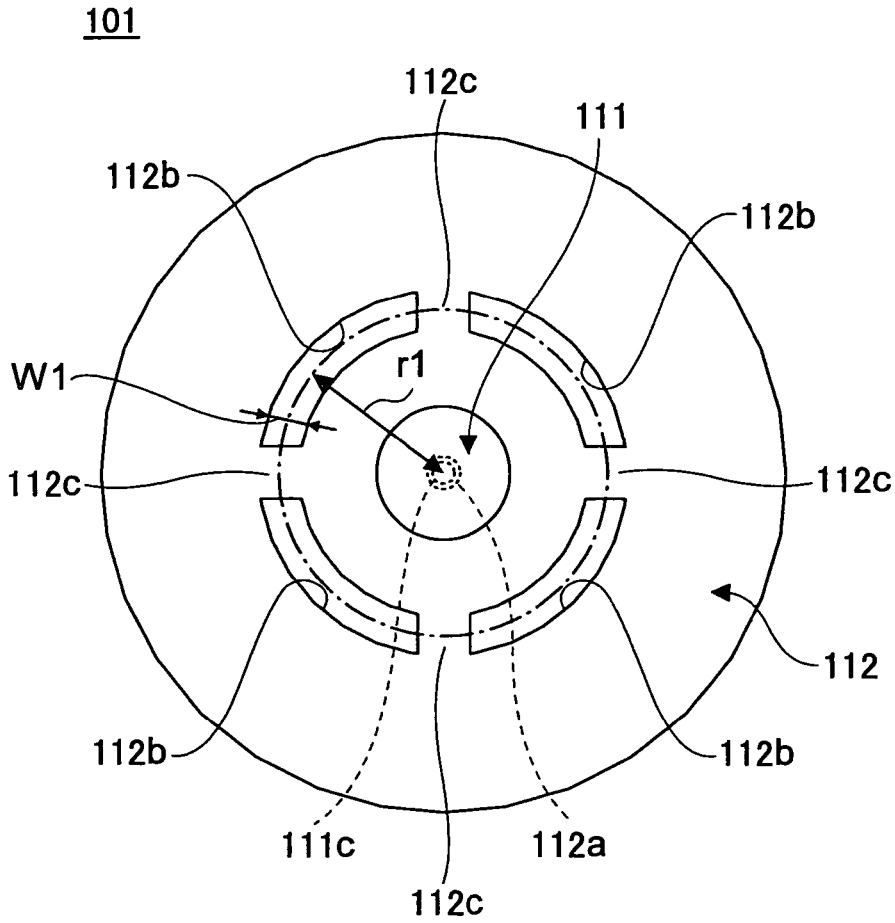
FIGS. 4A and 4B are schematic diagrams of an antenna 101.
Figure 4B:
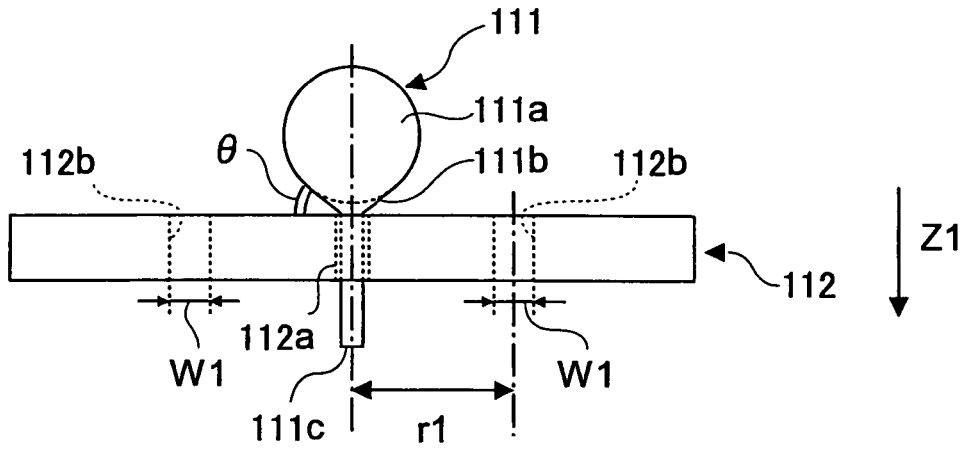

FIGS. 4A and 4B are schematic diagrams of the antenna 101.

The antenna 101 includes a feeder unit 111 and a ground plate 112. The feeder unit 111 is made from an electrically conductive material, such as a metal, and includes a sphere section 111*a*, a cone section 111*b*, and a feeder section 111*c* structured in one body. The sphere section 111*a* is arranged such that it is embedded in the base of cone section 111*b*.

The cone section 111*b* is set up so that the side of the cone section 111*b* and the surface of the ground plate 112 make an angle θ. The feeder section 111*c* is extended in the direction of Z1 from the apex of the cone section 111*b*. The feeder section 111*c* passes through a center hole 112*a* from the surface side to the rear side of the ground plate 112. The feeder section 111*c* is connected to the transceiver unit 102 on the rear side of the ground plate 112.

The ground plate 112 is made from an electrically conductive material, is formed in the shape of a disk, and is grounded. The center hole 112*a* that provides an opening between the surface and the rear side is formed at the center of the ground plate 112. Through the center hole 112*a*, the feeder section 111*c* of the feeder unit 111 is passed. At this time, between the feeder section 111*c* and the wall of the center hole 112*a*, an insulator is inserted such that the feeder unit 111 and the ground plate 112 are electrically insulated.

Further, through-holes 112*b* each in the shape of a circular arc are formed in the ground plate 112 along a circle having a radius r1 from the center, the width of the through-holes 112*b* being W1. The inside and the outside of the circle, along which circle the through-holes 112*b* are provided, are electrically and mechanically connected by bridge sections 112*c* prepared every 90 degrees. According to the antenna 101 structured in this way, an electromagnetic wave generated between the feeder unit 111 and the ground plate 112 is influenced by the through-holes 112*b*, providing a filtering effect.

The transceiver unit 102 is connected to the feeder unit 111, and supplies a transmission signal to the feeder unit 111.

Figure 5:
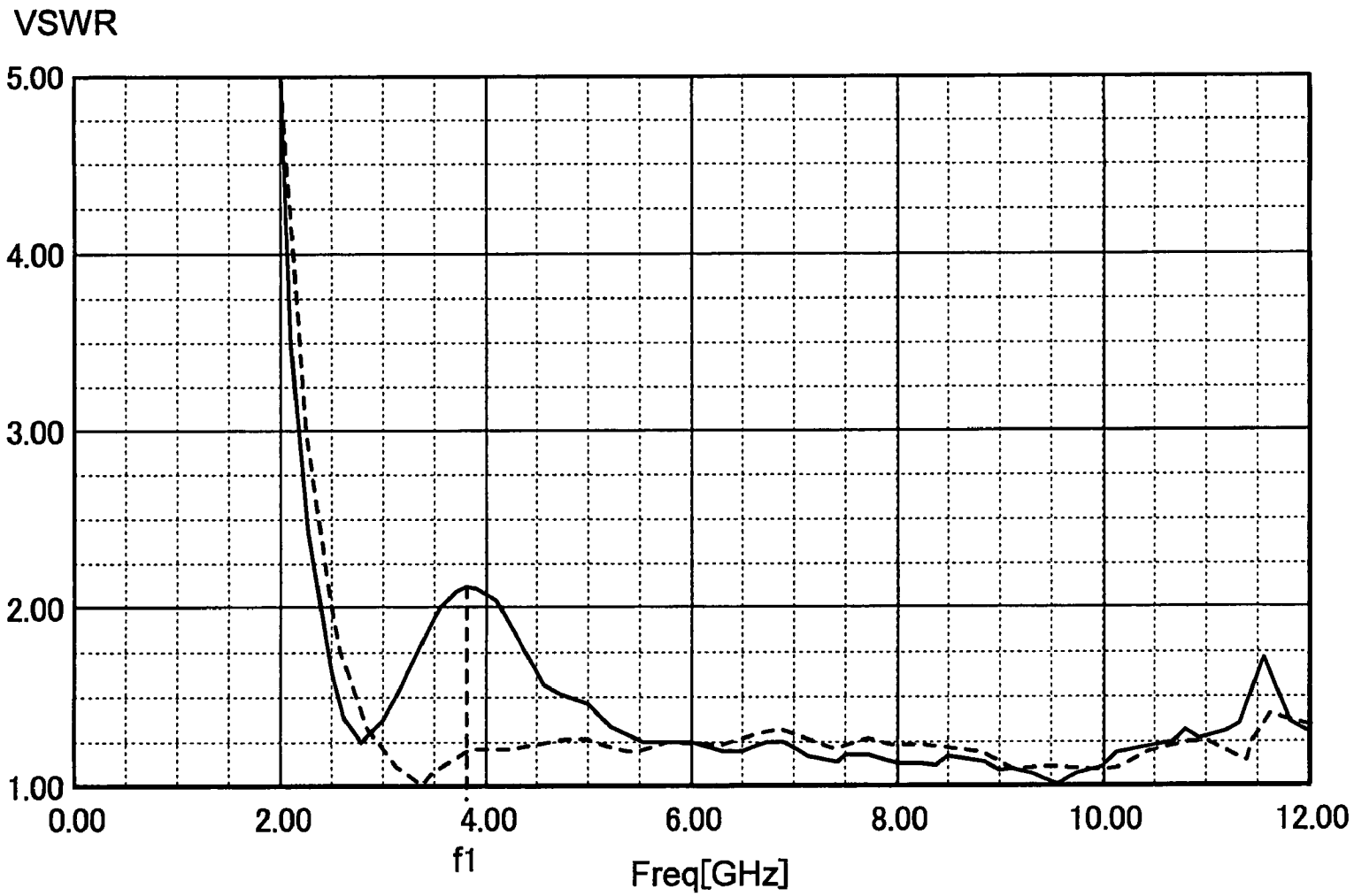
FIG. 5 graphs a frequency characteristic of the antenna 101.

FIG. 5 shows the frequency characteristic of the antenna 101. In FIG. 5, the horizontal axis represents the frequency and the vertical axis represents VSWR. In FIG. 5, a solid line shows the frequency characteristic in the case that the through-holes 112*b* are provided in the ground plate 112, and a dashed line shows the frequency characteristic in the case that there are no through-holes prepared in the ground plate 112.

As shown in FIG. 5, the through-holes 112*b* generate a greater VSWR around a frequency f1.

The Second Embodiment

Figure 6:
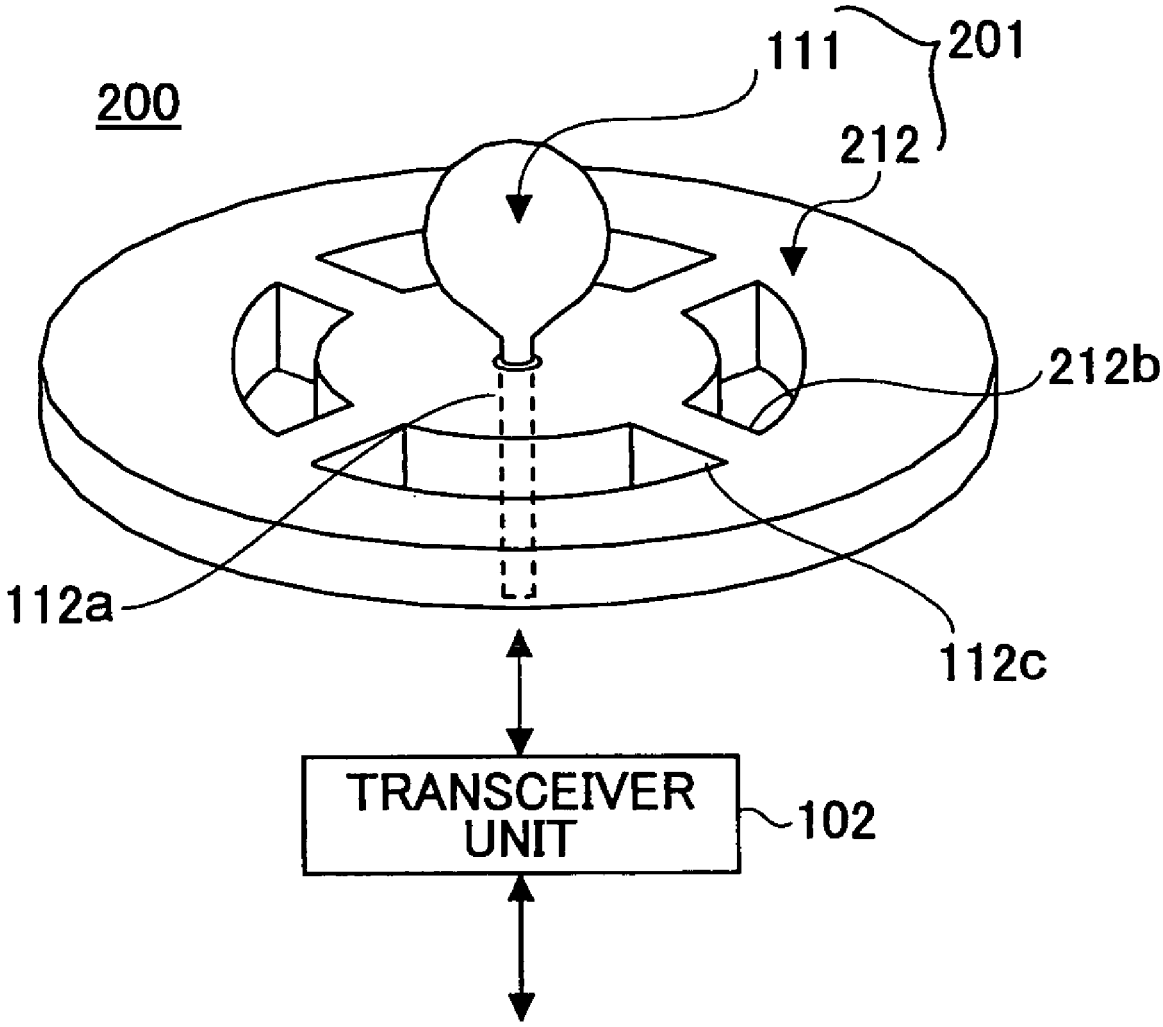
FIG. 6 is a schematic diagram of a second embodiment of the present invention.
Figure 7A:
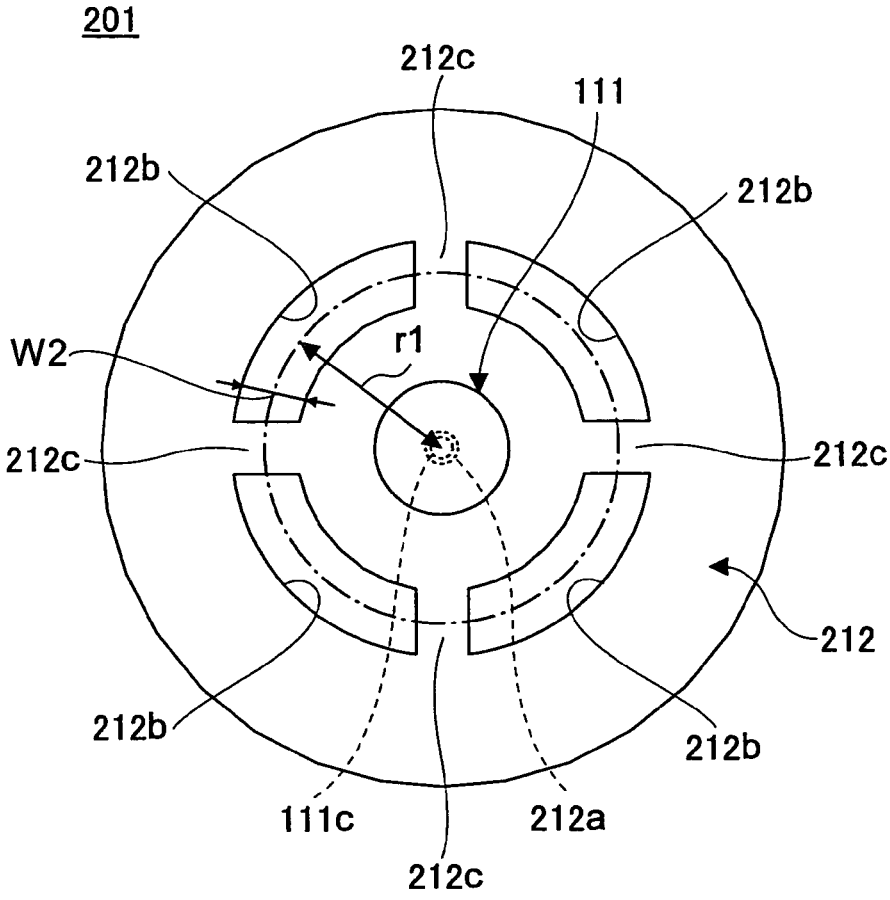
FIGS. 7A and 7B are schematic diagrams of an antenna 201.
Figure 7B:
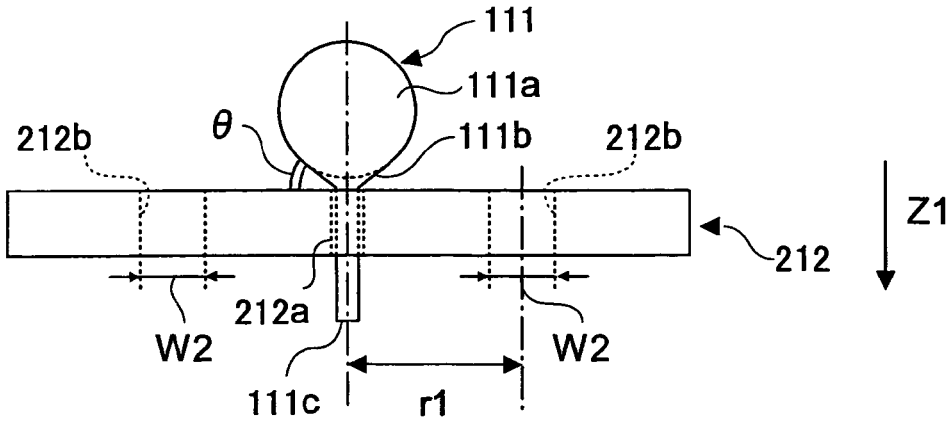

FIG. 6 is a schematic diagram of an antenna device 200 according to the second embodiment of the present invention, and FIGS. 7A and 7B are schematic diagrams of an antenna 201. In FIGS. 6 and 7, the same reference marks are given to the same components as FIG. 3 and FIGS. 4A and 4B, and explanations thereof are not repeated.

The antenna device 200 includes the antenna 201 that is different from the first embodiment in that the antenna 201 includes a ground plate 212 that is different from the first embodiment. The difference is that the ground plate 212 has through-holes 212*b* that have a width W2, as shown in FIGS. 7A and 7B, and the width W2 is greater than the width W1 of the through-holes 112*b* of the first embodiment, i.e., W2>W1. In this manner, a frequency characteristic that is different from the first embodiment is obtained.

Figure 8:
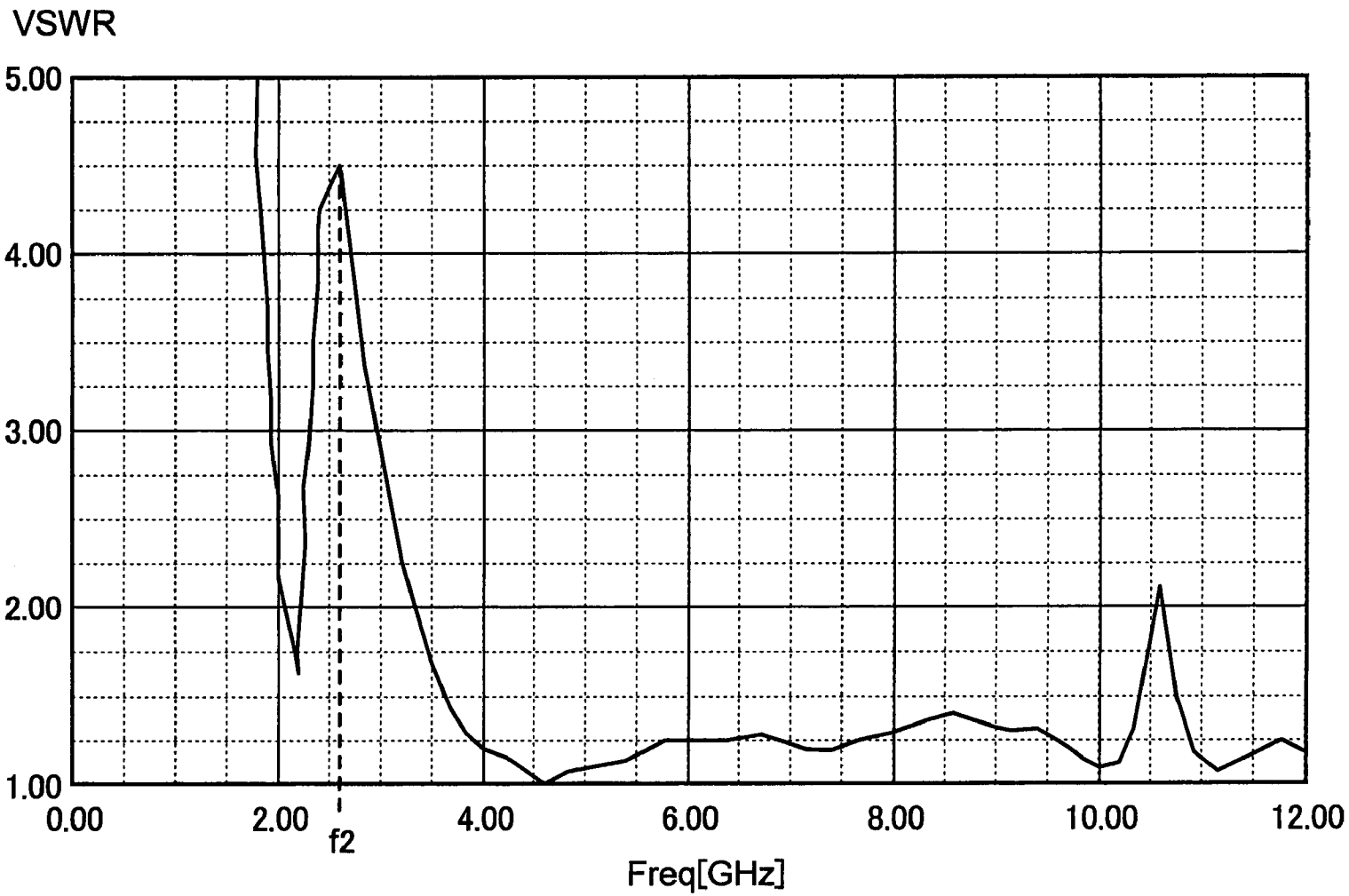
FIG. 8 is graphs a frequency characteristic of the antenna 201.

FIG. 8 shows the frequency characteristic of the antenna 201. In FIG. 8, the horizontal axis represents the frequency and the vertical axis represents VSWR.

By setting the width of through-holes 212*b* at W2, which is greater than W1, the VSWR peaks at a frequency f2 that is lower than f1 as shown in FIGS. 7A and 7B, and the magnitude of the VSWR is greater than the first embodiment.

As described above, a desired frequency characteristic can be obtained by properly setting the width W1 and W2 of the through-holes 112*b* and 212*b*, respectively. In this manner, according to this embodiment, an external filter is dispensed with for obtaining a desired frequency characteristic.

Thus, according to the first and the second embodiments of the present invention, change of the frequency characteristic is attained by changing the sizes of the through-holes 112*b* and 212*b*.

Further, it becomes possible to finely tune the frequency characteristic by inserting electrically conductive or dielectric pieces in the through-holes 112*b* and 212*b* as described below.

[The Adjustment Method of Antenna Device]

FIGS. A and 9B show how the frequency characteristic of the antenna device 101 according to the first embodiment the present invention is finely tuned.

Figure 9A:
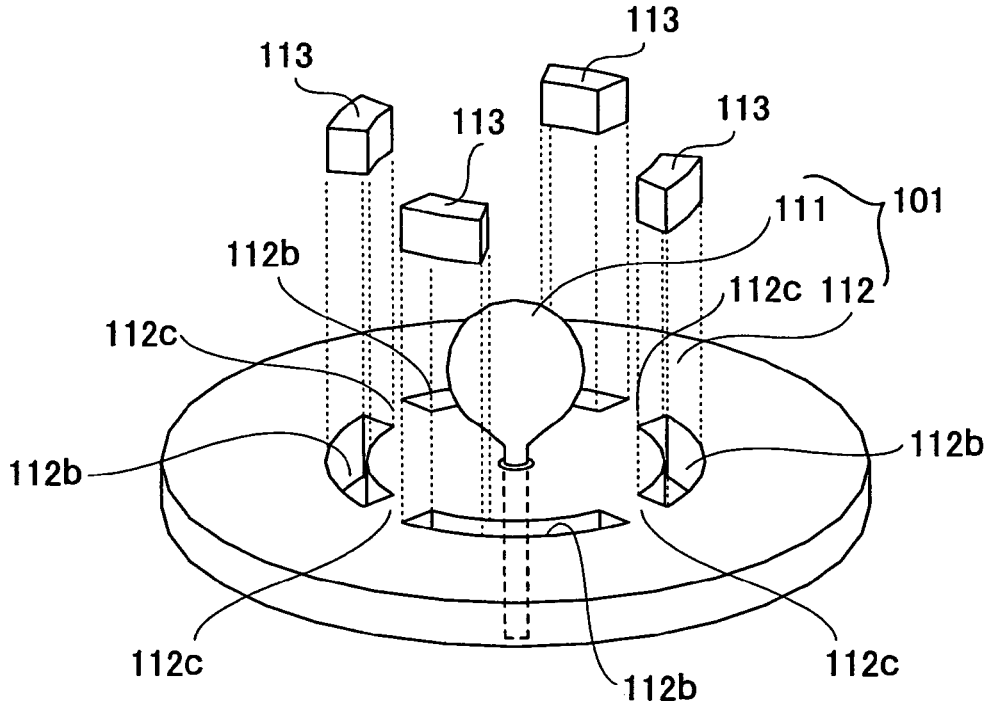
FIGS. 9A and 9B show a frequency characteristic adjustment method of the first embodiment the present invention.

A method is as shown in FIG. 9A, wherein electrically conductive pieces 113 are inserted in the through-holes 112*b* such that the opening size of the through-holes 112*b* is changed, and the frequency characteristic is adjusted.

Figure 9B:
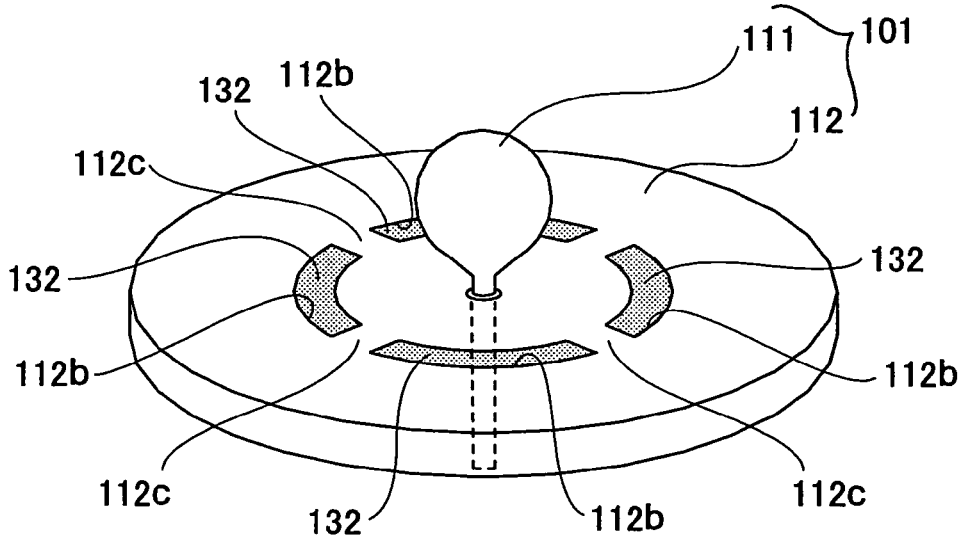

Another method is as shown in FIG. 9B, wherein molded resin 132 is molded in the through-holes 112*b* such that the dielectric constant of the molded parts is different from other places of the ground plate 112. In this manner, the frequency characteristic is adjusted, and in addition, there is a wavelength shortening effect.

Figure 10:
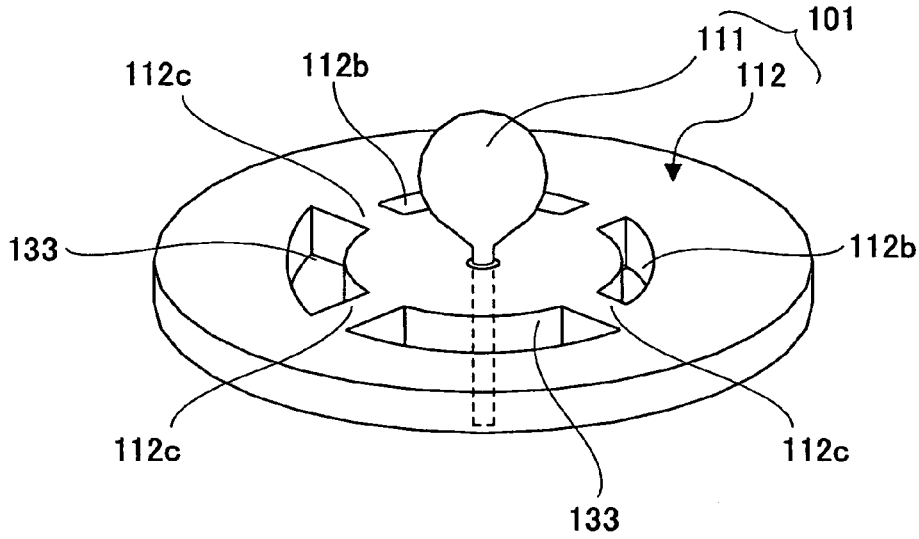
FIG. 10 shows a directivity adjustment method of the first embodiment the present invention.

FIG. 10 shows how the directivity of the antenna 101 of the first embodiment of the present invention is adjusted.

Here, through-holes 133 are shaped to be different from the through-holes 112*b* as shown in FIG. 10. This arrangement provides an asymmetry, therefore, directivity, to the antenna 101.

[The Third Embodiment]

Figure 11:
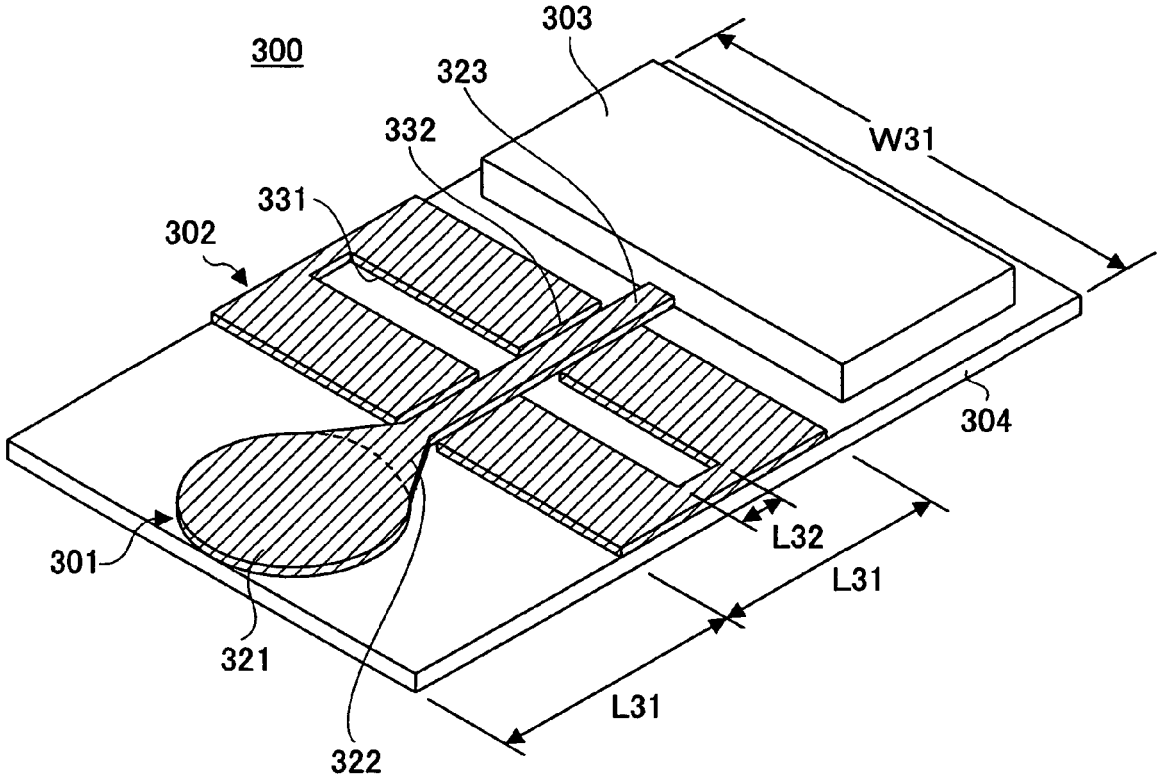
FIG. 11 is a perspective diagram of a third embodiment of the present invention.
Figure 12A:
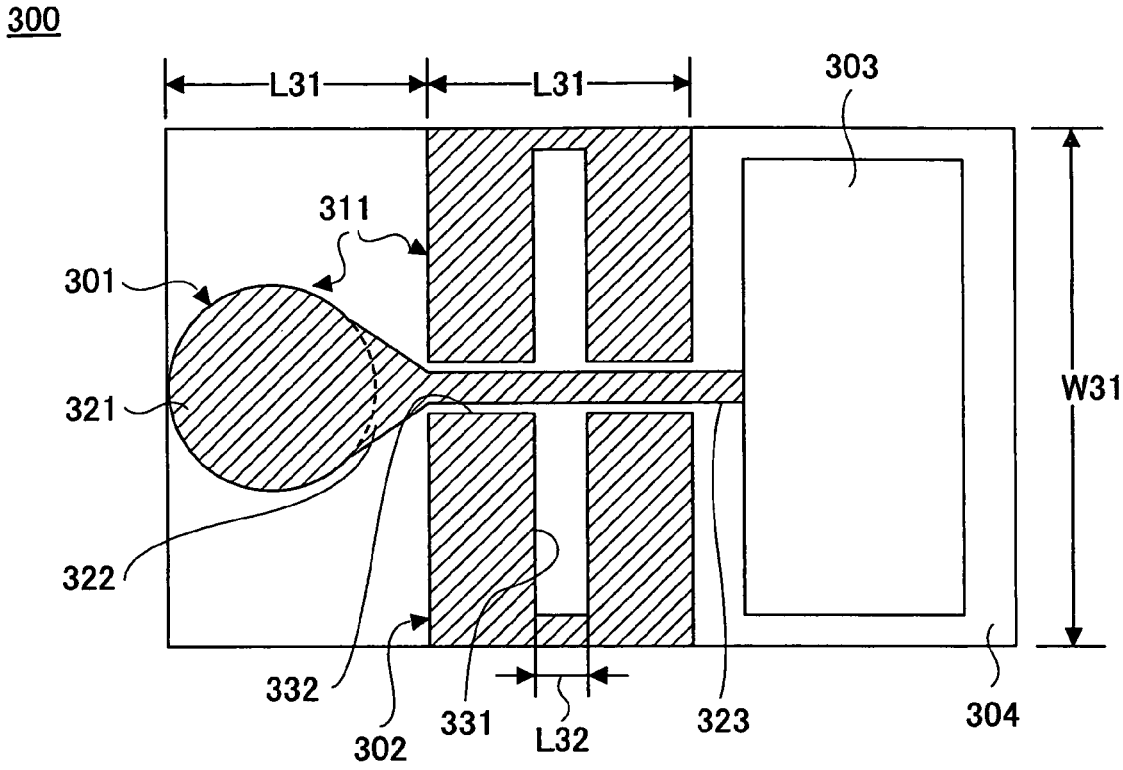
FIGS. 12A and 12B are schematic diagrams of the third embodiment of the present invention.
Figure 12B:
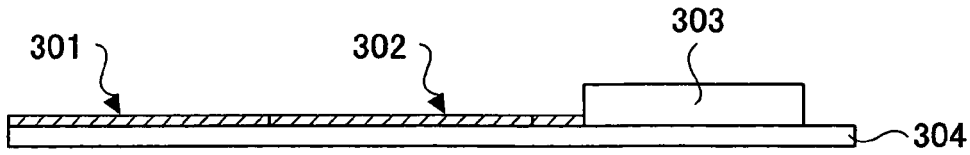

FIG. 11 is a perspective diagram of an antenna device 300 according to the third embodiment of the present invention, and FIGS. 12A and 12B are schematic diagrams thereof.

The antenna device 300 includes a feeding unit 301, a ground plate 302, and a transceiver unit 303 prepared on a printed wiring board 304.

The feeding unit 301 is formed by an electrically conductive pattern 311 provided on the printed wiring board 304. The electrically conductive pattern 311 is formed in the shape that is obtained when the center of the antenna 101 shown in FIG. 3 and FIGS. 4A and 4B are cut by a plane that is perpendicular to the ground plate 112, and includes a circular pattern 321, a triangular pattern 322, and a feeder pattern 323. The circular pattern 321 corresponds to the sphere section 111*a* of the feeding unit 111 of the first and of second embodiments, a part of the circumference of the circular pattern 321 being connected to the base side of the triangular pattern 322.

The triangle pattern 322 corresponds to the cone section 111*b* of the feeding unit 111 of the first and the second embodiments, and is arranged such that the apex of the triangular pattern 322 faces the ground plate 302. The feeder pattern 323 connects the apex of the triangular pattern 322 and the transceiver unit 303, the feeder pattern 323 being insulated from the ground plate 302. In this manner, the transmission signal output from the transceiver unit 303 is provided to the feeding unit 301.

The ground plate 302 having a length L31 and width W31 is formed between the feeding unit 301 and the transceiver unit 303. The ground plate 302 includes a filter section 331 for filtering the transmitted electric wave, and a penetration section 332 for the feeder pattern 323 to run through.

The filter section 331 having a length L32 is constituted by a pattern made from a non-conductive material, and is located near the center of the ground plate 302. The filter section 331 influences the electromagnetism between the ground plate 302 and the feeding unit 301, and VSWR of a specific frequency is changed.

Figure 13:
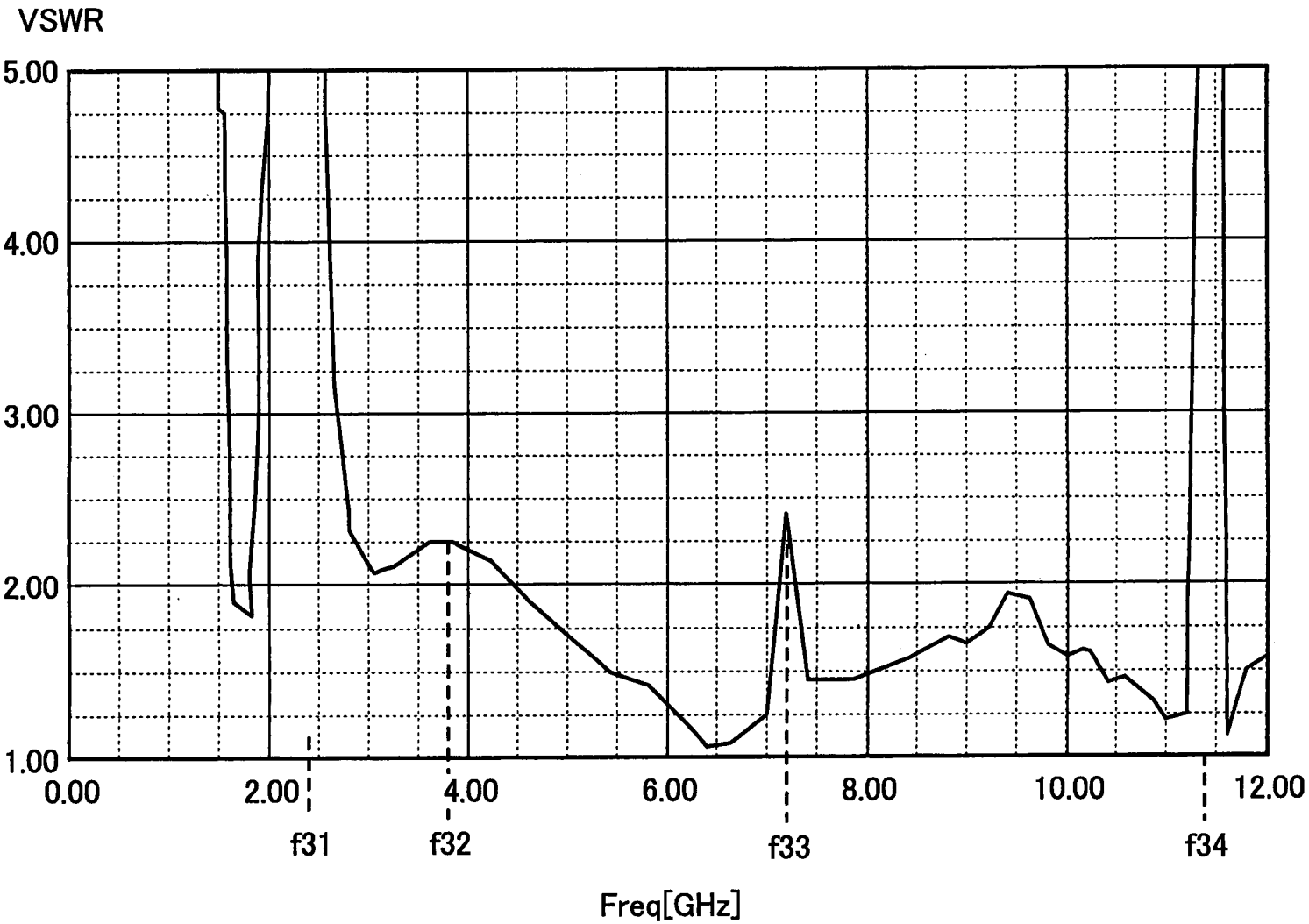
FIG. 13 graphs a frequency characteristic of the third embodiment of the present invention.

FIG. 13 shows the frequency characteristic of the third embodiment of the present invention, wherein the horizontal axis represents the frequency, and the vertical axis represents VSWR.

The characteristic shown in FIG. 13 is in the case of L31=25 mm, L32=7 mm, and W31=50 mm. According to the embodiment, VSWR is great at frequencies f31, f32, f33, and f34 as shown in FIG. 13. Especially, at the frequencies f31 and f34, VSWR is remarkably great.

As described above, according to this embodiment, the antenna device 300 is constituted by the electrically conductive pattern 311 on the printed wiring board 304, and further, the transceiver unit 303 is mounted on the printed wiring board 304. In this way, the antenna device 300 is made small and thin.

[The Fourth Embodiment]

Figure 14:
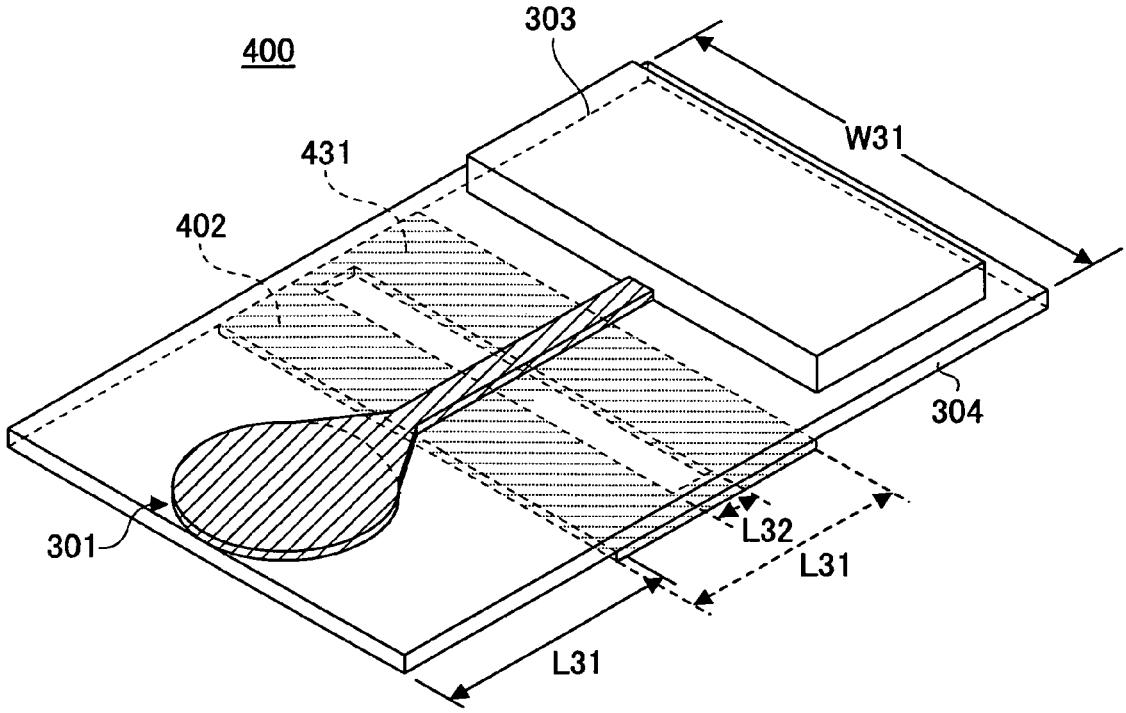
FIG. 14 is a perspective diagram of a fourth embodiment of the present invention.
Figure 15A:
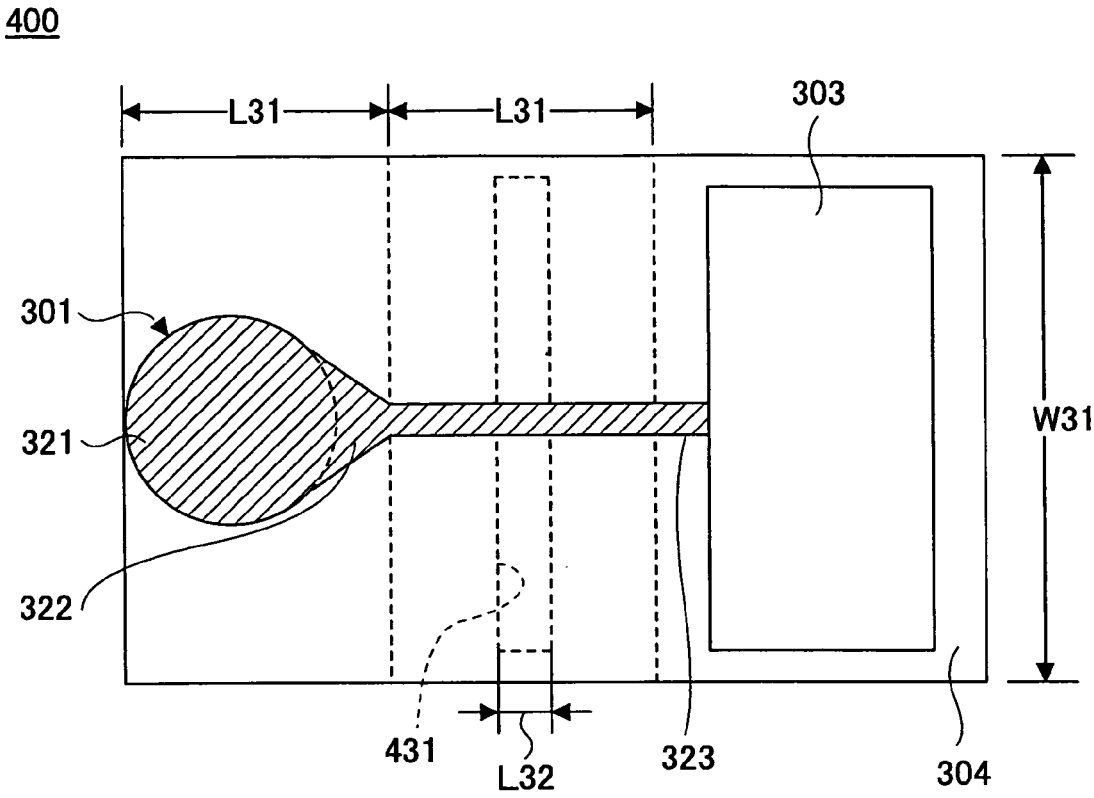
FIGS. 15A and 15B are schematic diagram of the fourth embodiment of the present invention.
Figure 15B:
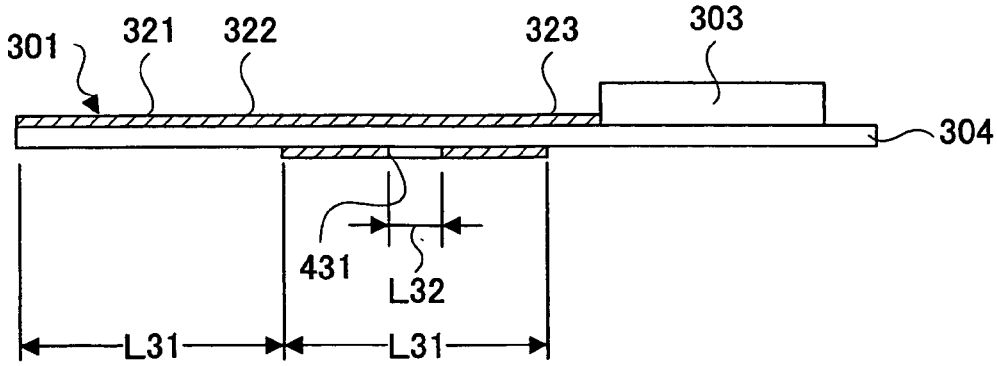

FIG. 14 is a perspective diagram of an antenna device 400 according to the fourth embodiment of the present invention, and FIGS. 15A and 15B are schematic diagrams of the fourth embodiment.

The antenna device 400 includes a ground plate 402 that is provided on the rear side (undersurface) of the printed wiring board 304.

The ground plate 402 has a length L31 and a width W31, and is provided at a position corresponding to between the feeding unit 301 and the transceiver unit 303 on the rear side of the printed wiring board 304. The ground plate 402 includes a filter section 431 for filtering the frequency of a transmitted electric wave.

The filter section 431 having the length L32 is constituted by a pattern of a non-conductive material, and is provided near the center of the ground plate 402. The filter section 431 influences the electromagnetism between the ground plate 402 and the feeding unit 301, and VSWR changes at a specific frequency.

When L31=25 mm, L32=7 mm, and W31=50 mm, nearly the same frequency characteristic as shown by FIG. 13 is obtained.

[The Fifth Embodiment]

Figure 16:
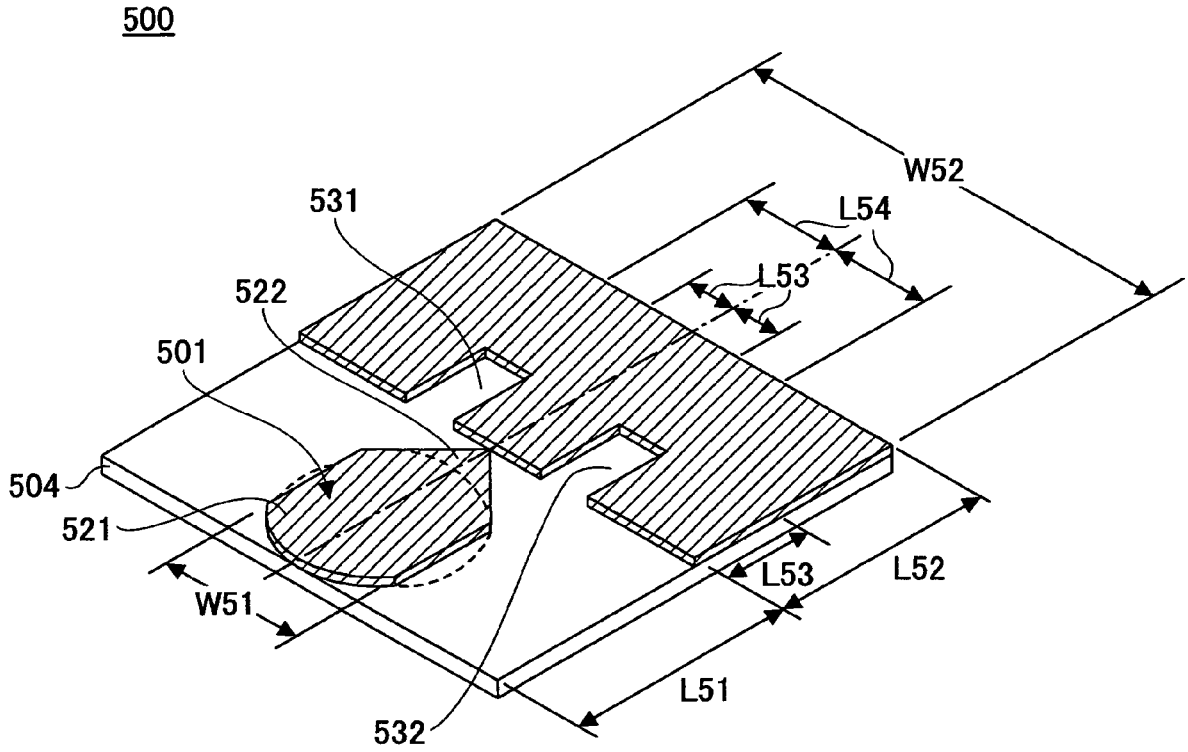
FIG. 16 is a perspective diagram of a fifth embodiment of the present invention.
Figure 17A:
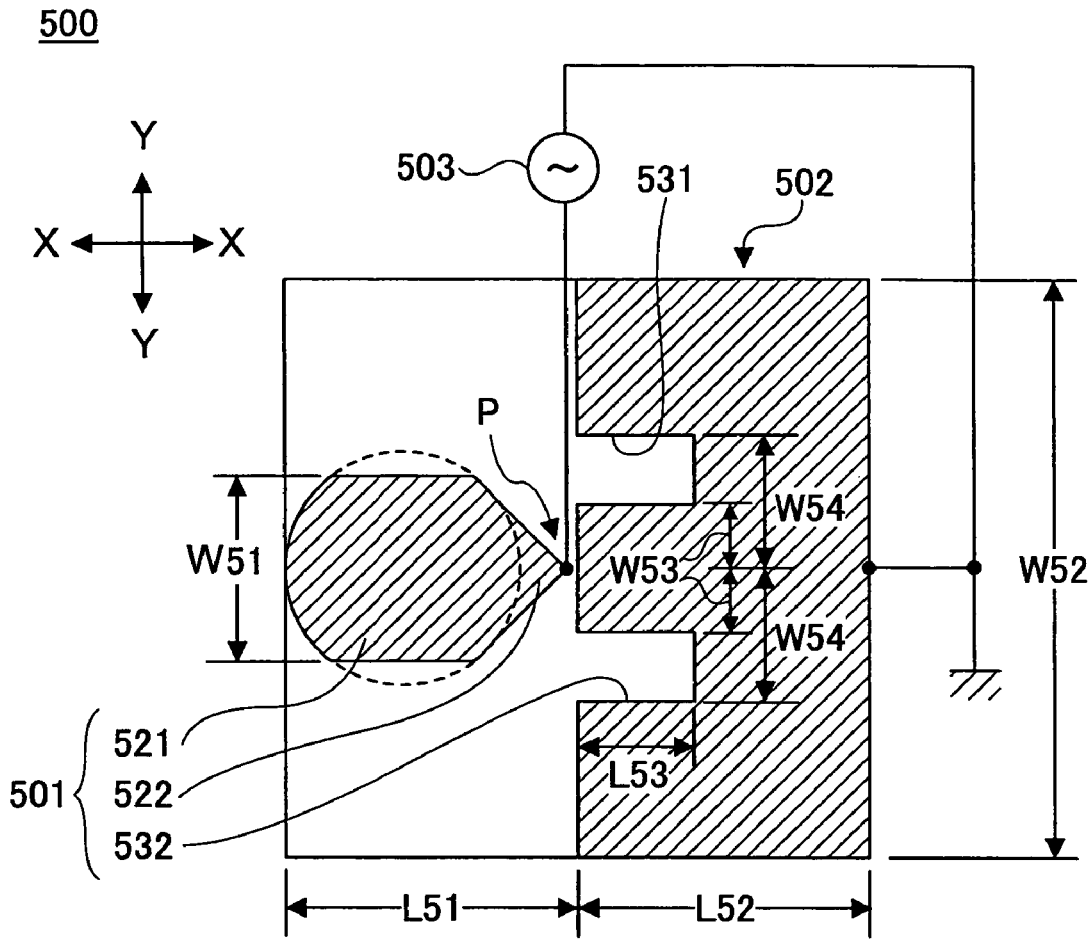
FIGS. 17A and 17B are schematic diagrams of the fifth embodiment of the present invention.
Figure 17B:
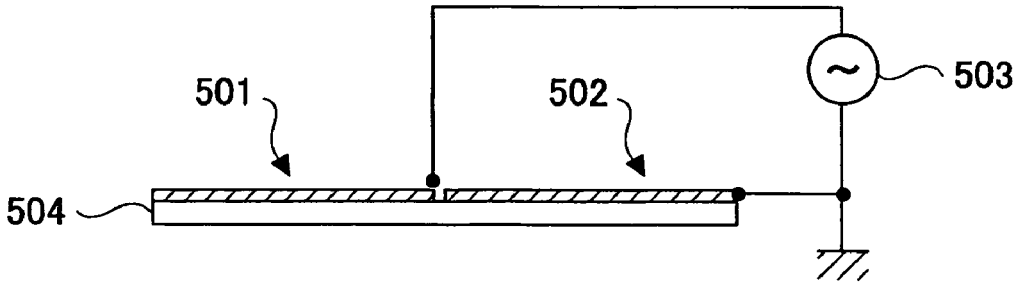

FIG. 16 is a perspective diagram of an antenna device 500 according to the fifth embodiment of the present invention, and FIGS. 15A and 15B are schematic diagrams of the fifth embodiment.

The antenna device 500 includes a feeding unit 501, a ground plate 502, a transceiver unit 503, and a printed wiring board 504.

The feeding unit 501 and the ground plate 502 are formed by an electrically conductive pattern having a thickness t on the printed wiring board 504. The feeding unit 501 is the same as the circular section 321 of the feeding unit 301 of the third and the fourth embodiments, except that both ends in the directions of arrows Y are cut off parallel to the directions of arrows X. The feeding unit 501 has a length L51 and a width W51.

As for the feeding unit 501, the apex of the triangle section 522 serves as a feeding point p, and the transceiver unit 503 is connected to the feeding point p.

The ground plate 502 having a length L52 and a width W52 is connected to the ground. Concavities 531 and 532 are formed in the ground plate 502 on both sides of the feeding point p, i.e., the center of the ground plate 502 in the directions of the arrows Y.

Formation of the concavities 531 and 532 starts at a distance equivalent to W53 measured from the center of the ground plate 502 in the directions of the arrows Y, and ends at a distance equivalent to W54 measured from the center of the ground plate 502 in the directions of the arrows Y. The concavities 531 and 532 each have a length L54. The electromagnetism between the ground plate 502 and the feeding unit 501 is influenced by the concavities 531 and 532, and the VSWR changes at a specific frequency.

Figure 18:
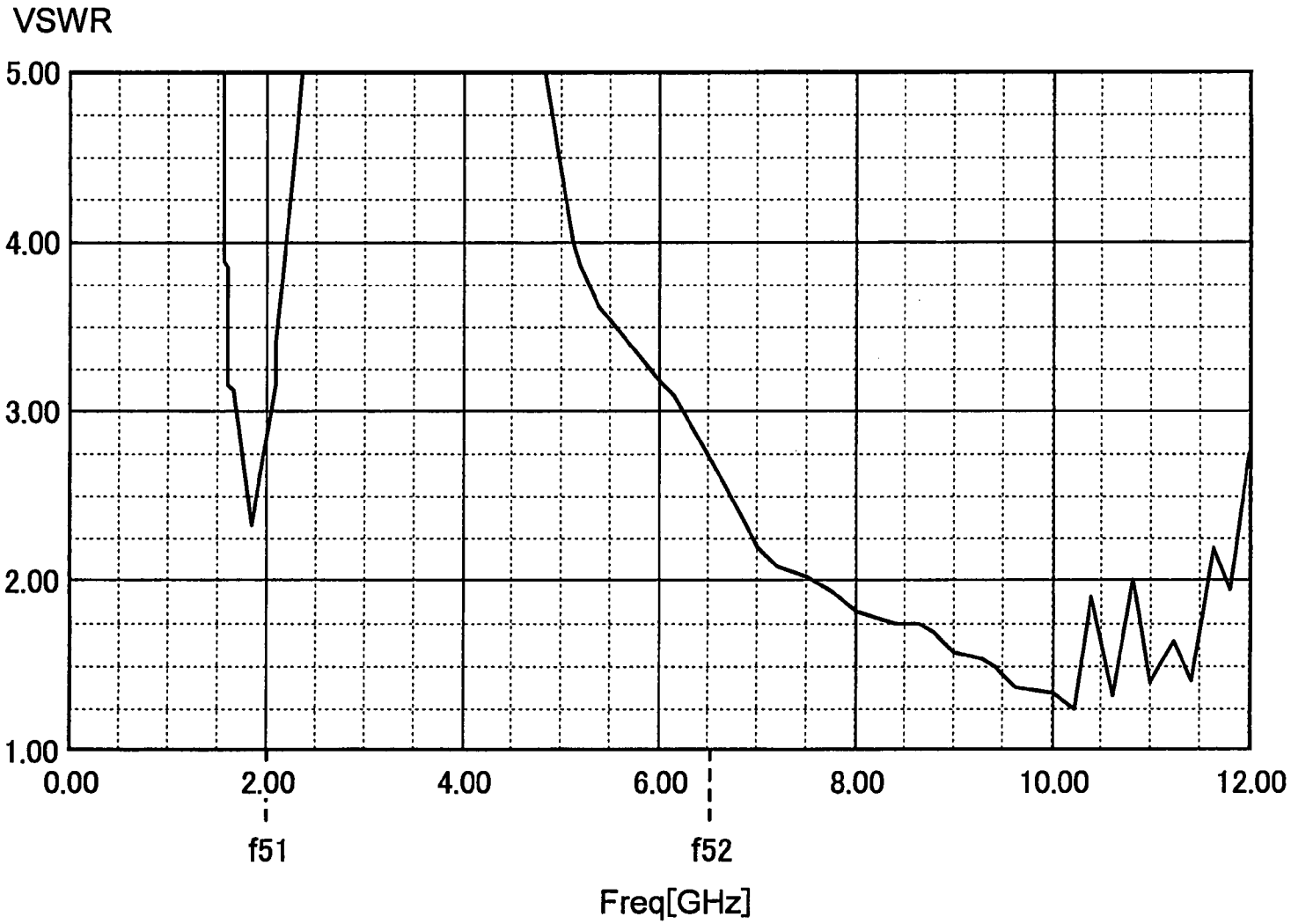
FIG. 18 graphs a frequency characteristic of the fifth embodiment of the present invention.

FIG. 18 shows the frequency characteristic of the fifth embodiment of the present invention, wherein the horizontal axis represents the frequency, and the vertical axis represents VSWR.

The property shown in FIG. 18 is the frequency characteristic in the case of t=0.8 mm L51=25.1 mm, L52=25.0 mm, L53=12.5 mm, W51=16 mm, W52=50 mm, W53=5 mm, and W54=10 mm. According to this embodiment, the VSWR is remarkably great for a frequency band between f51 and f52.

Further, the present invention is not limited to these embodiments, but various variations and modifications may be made without departing from the scope of the present invention.

The present application is based on Japanese Priority Application No. 2004–066117 filed on Mar. 9, 2004, with the Japanese Patent Office, the entire contents of which are hereby incorporated by reference.

What is claimed is:

1. An antenna device, comprising:

a ground plate of a plate-like shape and conductive material;

a feeding unit perpendicular to and insulated from the ground plate, extending from a surface of the ground plate at a predetermined angle for a predetermined length; and a non-conducting section constituted by two or more through-hole openings in the ground plate in a shape corresponding to a frequency characteristic, wherein an inside and an outside of the non-conducting section are connected by at least one bridge section, and the through-hole openings, each in the shape of a circular arc, are formed in the ground plate along a circle having a designated radius from a center.

2. An antenna device, comprising:

a ground plate and a feeding unit, each comprising a conductive pattern formed on a circuit board;

the feeding unit being perpendicular to the ground plate and extending from the ground plate at a predetermined angle for a predetermined length; and a non-conductive section formed in a portion of the ground plate where the conductive pattern is not provided and in a shape corresponding to a frequency characteristic, wherein the non-conductive section comprises a concavity Provided on a side of the ground plate facing the feeding unit.

3. The antenna device as claimed in claim 2, wherein the non-conductive section comprises an area nearly at the center of the ground plate having the conductive pattern, the area being surrounded by the ground plate.

4. A method of adjusting an antenna device comprising a ground plate, a feeding unit, perpendicular to the ground plate and extending from the ground plate at a predetermined angle for a predetermined length; and a non-conductive section comprising holes formed in the ground plate in a shape corresponding to a frequency characteristic, the method comprising:

adjusting the form of the non-conductive section to achieve a desired frequency characteristic by inserting a dielectric component in a corresponding hole.

5. The method of adjusting the antenna device as claimed in claim 4, further comprising:

adjusting directivity by forming the non-conductive section to be asymmetric.

6. The method of adjusting the antenna device as claimed in claim 4, further comprising:

adjusting the frequency characteristic by adjusting the form of the feeding unit.

7. An antenna device, comprising:

a feeding unit perpendicular to and insulated from a ground plate, extending from a surface of the ground plate for a predetermined length; and a non-conducting section constituted by two or more through-hole openings, connected by at least one bridge section, in the ground plate in a shape corresponding to a frequency characteristic, wherein the through-hole openings, each in the shape of a circular arc, are formed in the ground plate along a circle having a designated radius from a center.

* * * * *

UNITED STATES PATENT AND TRADEMARK OFFICE

CERTIFICATE OF CORRECTION

PATENT NO. : 7,161,547 B2
APPLICATION NO. : 10/954204
DATED : January 9, 2007
INVENTOR(S) : Masahiro Yanagi et al.

It is certified that error appears in the above-identified patent and that said Letters Patent is hereby corrected as shown below:

Column 7, Line 8-9, change "Provided" to --provided--.

Signed and Sealed this

First Day of April, 2008

JON W. DUDAS
*Director of the United States Patent and Trademark Office*